US012371823B1

(12) United States Patent
Grace et al.

(10) Patent No.: US 12,371,823 B1
(45) Date of Patent: Jul. 29, 2025

(54) MACHINE FOR FABRICATING A CONTINUOUS LOOP OF TWINE

(71) Applicant: Siemens Medical Solutions USA, Inc., Malvern, PA (US)

(72) Inventors: Kenneth Grace, Oak Ridge, TN (US); Jeremy Yarrington, Carpentersville, IL (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 18/645,637

(22) Filed: Apr. 25, 2024

(51) Int. Cl.
*D02G 3/38* (2006.01)
*D02G 3/44* (2006.01)

(52) U.S. Cl.
CPC ..... *D02G 3/38* (2013.01); *D02G 3/44* (2013.01); *D10B 2505/00* (2013.01)

(58) Field of Classification Search
CPC ..... D02G 3/38; B66C 1/12; B66C 1/18
See application file for complete search history.

(56) References Cited

U.S. PATENT DOCUMENTS 758,286 A * 4/1904 Warner ..... D04C 1/06 87/9
1,587,856 A * 6/1926 Reed ..... D04D 1/00 57/3
1,614,206 A * 1/1927 Alphonso ..... B60C 15/04 57/201
2,260,719 A * 10/1941 Merrifield ..... F16G 9/00 156/441
2,598,829 A * 6/1952 Pollard ..... F16G 9/00 57/201
3,793,816 A * 2/1974 Kodama ..... D06B 7/04 57/295
5,258,040 A * 11/1993 Bruchman ..... A61F 2/08 623/909
6,352,603 B1 * 3/2002 Bryant ..... A61B 17/0401 156/308.2
6,490,852 B1 * 12/2002 Mustacich ..... G01N 30/30 57/3
8,695,318 B2 * 4/2014 Ogawa ..... B29D 30/48 57/11

FOREIGN PATENT DOCUMENTS

WO WO-2007116857 A1 * 10/2007 ..... B60C 15/04

* cited by examiner

*Primary Examiner* — Shaun R Hurley

(57) ABSTRACT

A threading machine performs a method for creating a continuous loop of twine. A plate has a first face, a second face opposite the first face, and a hole therethrough. A ring gear is disposed on the first face and rotates about a central axis aligned with the hole. A drive pulley unwinds the thread from a spool on the ring gear and through the central axis of the ring gear in a threading direction. The drive pulley directs the thread through the ring gear a plurality of times. The ring gear is held stationary as the drive pulley unwinds the thread during a first manufacturing step to form a core of the continuous loop and rotates as the drive pulley unwinds the thread during a second manufacturing step to wrap the thread around the core to form an outer wrap around the core.

17 Claims, 4 Drawing Sheets

MACHINE FOR FABRICATING A CONTINUOUS LOOP OF TWINE

BACKGROUND

The present invention relates to manufacturing twine, and more specifically, to an apparatus for creating a continuous loop of twine from a single thread.

Processing of a Sodium Iodide (NaI) crystal into radiation-detecting plates utilizes a saturated cotton/polyester twine to carry water to a cutting plane of the crystal. The water melts the NaI along a planar cut made in the crystal in the cutting plane. A continuous loop of twine is used to accomplish this. Currently, a continuous loop of twine is fabricated by splicing and bonding together opposite ends of a thread. As the ends are generally frayed, the resulting splice can have undesirable discontinuities and weaknesses. Accordingly, there is a need for a method of manufacturing a continuous loops of twine that does not include these discontinuities.

SUMMARY

According to an embodiment of the present invention, a method of manufacturing a continuous loop of twine is disclosed. A thread is unwound from a spool disposed on a ring gear to pass through a central axis of the ring gear in a threading direction. The thread is threaded around the ring gear to pass through the central axis a plurality of times in the threading direction during a first manufacturing step via a drive pulley, wherein the ring gear is held stationary during the first manufacturing step to form a core of the loop. The ring gear is rotated while the thread is unwinding from the spool during a second manufacturing step to wrap the thread around the core as the core passes through the axis in the threading direction, thereby forming an outer wrap around the core.

According to another embodiment of the present invention, a system for manufacturing a continuous loop of twine is disclosed. The system includes a ring gear rotatable about an axis, a spool disposed on the ring gear, the spool including a thread, and a drive pulley for unwinding the thread from the spool and through the ring gear through a central axis of the ring gear in a threading direction, where the drive pulley directs the thread through the ring gear a plurality of times. The ring gear is held stationary as the drive pulley unwinds the thread during a first manufacturing step to form a core of the continuous loop and rotates as the drive pulley unwinds the thread during a second manufacturing step to wrap the thread around the core to form an outer wrap around the core.

According to another embodiment of the present invention, a threading machine for creating a continuous loop of twine is disclosed. The threading machine includes a plate having a first face and a second face opposite the first face, the plate having a hole therethrough, a ring gear disposed on the first face and rotatable about a central axis aligned with the hole, a spool disposed on the ring gear, the spool including a thread, and a drive pulley for unwinding the thread from the spool and through the ring gear through the central axis of the ring gear in a threading direction, where the drive pulley directs the thread through the ring gear a plurality of times. The ring gear is held stationary as the drive pulley unwinds the thread during a first manufacturing step to form a core of the continuous loop and rotates as the drive pulley unwinds the thread during a second manufacturing step to wrap the thread around the core to form an outer wrap around the core.

DETAILED DESCRIPTION

Figure 1:
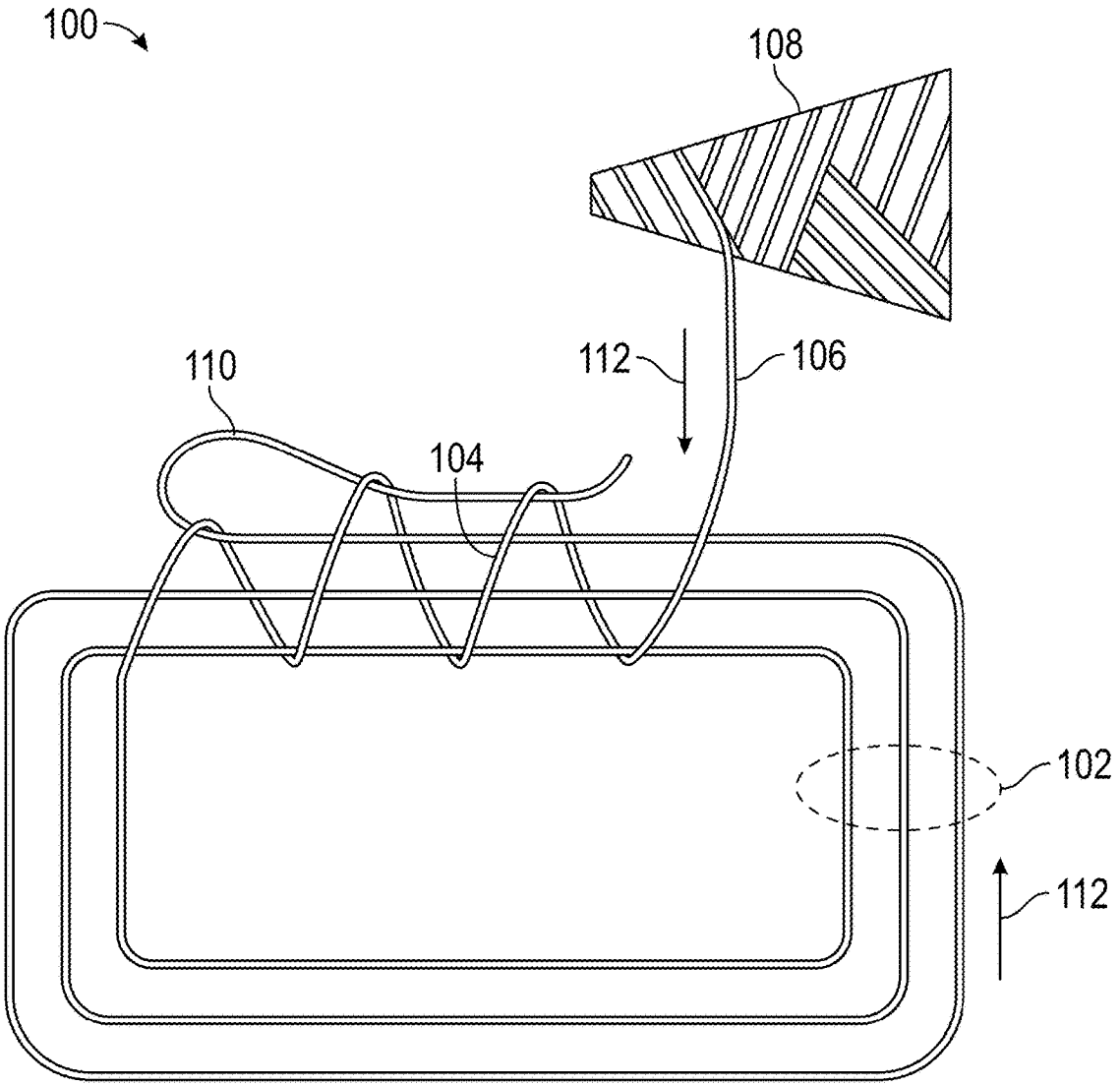
FIG. 1 show a continuous loop of twine, in an embodiment.

With reference now to FIG. 1, a continuous loop 100 of twine is shown in an embodiment. The continuous loop 100 includes a core 102 and an outer wrap 104 around the core 102. A thread 106 is stored on a spool 108. The thread 106 is unwound from the spool 108 by its free end 110 to form the continuous loop 100. The core 102 forms a loop, with the thread 106 circling the loop several times in a threading direction 112. In an embodiment, the thread 106 circles the loop three times (i.e., the loop is 3-ply). After forming the loop, a portion of the thread 106 that is being unraveled from the spool 108 is used to form the outer wrap 104 by circling a section of the core 102 a plurality of times. The outer wrap 104 therefore is a helical wrap e.g. like a corkscrew. In general, the outer wrap 104 makes at least one circuit around the length of the loop. The free end 110 of the thread 106 is turned back along the core 102 (against the threading direction 112) so that the outer wrap 104 also encircles the free end 110. Once a desired number of turns of the outer wrap 104 have been made, the thread 106 is cut and the freshly-cut end of the thread 106 is back-woven into the outer wrap 104 to complete the continuous loop 100 of twine.

Figure 2:
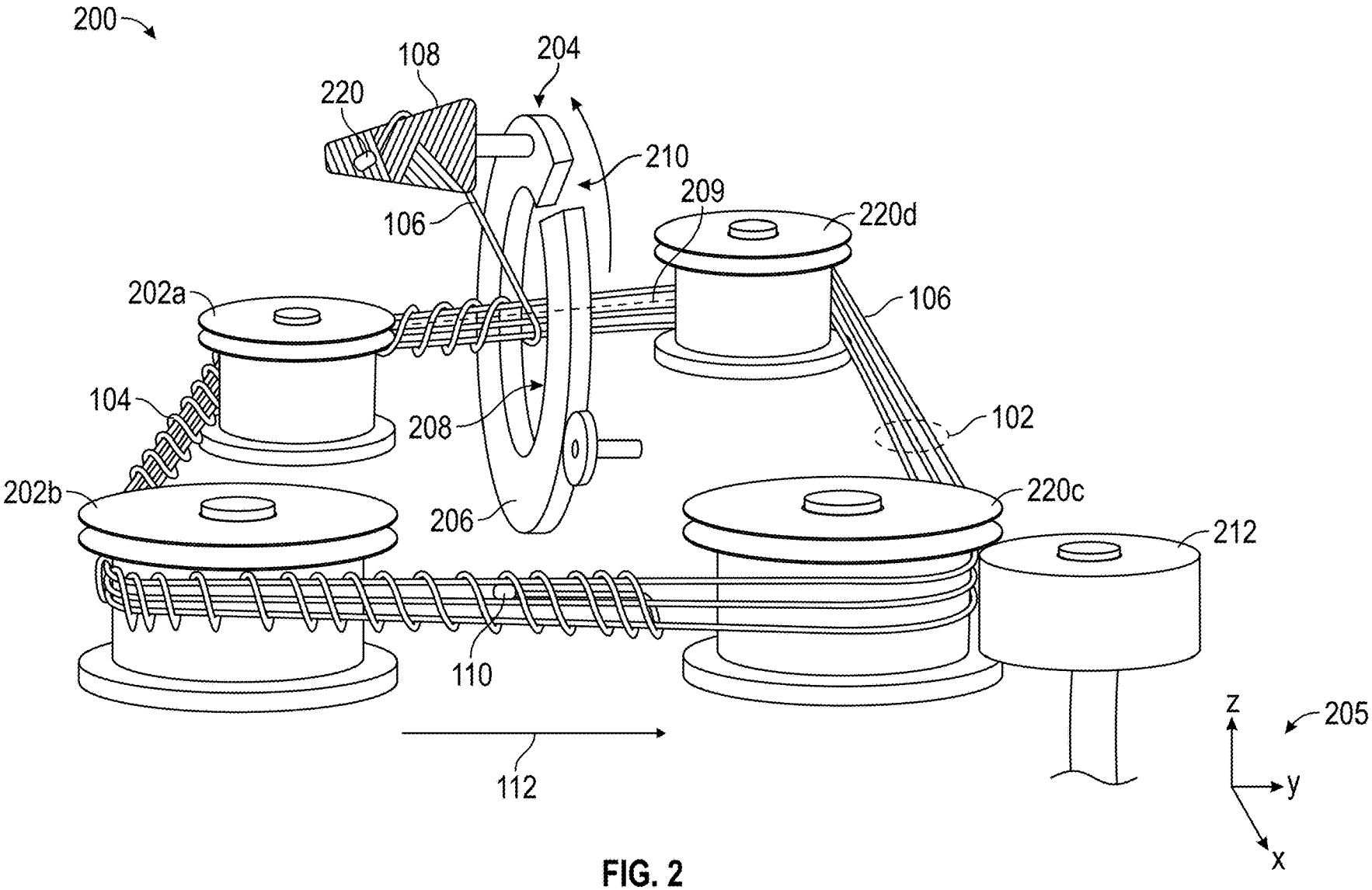
FIG. 2 shows a threading system for creating the continuous loop shown in FIG. 1.

FIG. 2 shows a threading system 200 for creating the continuous loop 100 shown in FIG. 1. The threading system 200 includes a plurality of pullies 202*a*, 202*b*, 202*c*, 202*d* and a ring gear 204. For ease of discussion, a coordinate system 205 is shown. For illustrative purposes, the plurality of pullies 202*a*, 202*b*, 202*c*, 202*d* is shown as disposed in an x-y plane and the ring gear 204 is located in an x-z plane. The ring gear 204 has a base circle 206 surrounding a central region 208 which is empty. The ring gear 204 rotates about a central axis 209. The base circle 206 includes a gap 210 that extends along a radial line of the base circle 206. The gap 210 allows the thread 106 to pass into and out of the central region 208. The spool 108 is disposed on the base circle 206. The plurality of pullies 202*a*, 202*b*, 202*c*, 202*d* is arranged to circulate the thread 106 through the central region 208 of the ring gear 204 along the central axis to form the continuous loop.

The thread 106 moves around the plurality of pullies 202*a*, 202*b*, 202*c*, 202*d* in the x-y plane in the threading direction 112. The ring gear 204 is capable of rotating within the x-z plane. A free end 110 of the thread 106 is passed through the central region 208 along the central axis 209 and onto the plurality of pullies 202*a*, 202*b*, 202*c*, 202*d*. As the plurality of pullies 202*a*, 202*b*, 202*c*, 202*d* rotate, the thread 106 is withdrawn from the spool 108. A pinch collar 212 can be used to facilitate flow of the thread around the plurality of pullies 202*a*, 202*b*, 202*c*, 202*d*. The pinch collar 212 includes a rotatable disc with an elastic or rubber perimeter. The pinch collar 212 is placed against a pulley (e.g., pulley 202*b*) so that the rubber perimeter is in contact with an outer perimeter surface of the pulley, thereby providing friction to facilitate motion of the thread 106 around the pulley 202*b*. The pulley 202*b* in contact with the pinch collar 212 can be referred to as a drive pulley due to its ability to actuate motion of the thread 106.

The continuous loop of twine is created in two manufacturing steps. In a first manufacturing step, the ring gear 204 is held stationary (i.e., non-rotating) and the plurality of pullies 202*a*, 202*b*, 202*c*, 202*d* are rotated until the free end 110 of the thread 106 has passes through the base circle 206 a selected number of times. Passing the thread through n times makes an n-ply core. In various embodiments, n=3 (i.e., a 3-ply core). In a second manufacturing step, the ring gear 204 rotates as the plurality of pullies 202*a*, 202*b*, 202*c*, 202*d* continue to rotate, thereby allowing the thread 106 to wrap around the (n-ply) core 102 as the core circulates around the plurality of pullies 202*a*, 202*b*, 202*c*, 202*d* to form the outer wrap 104. Once the continuous loop of twine is complete, the loop is removed from the system by being pulled through the gap 210 in the base circle 206. The thread 106 can then be cut at the spool 108 and the freshly-cut end 220 is tucked under the outer wrap 104.

Figure 3:
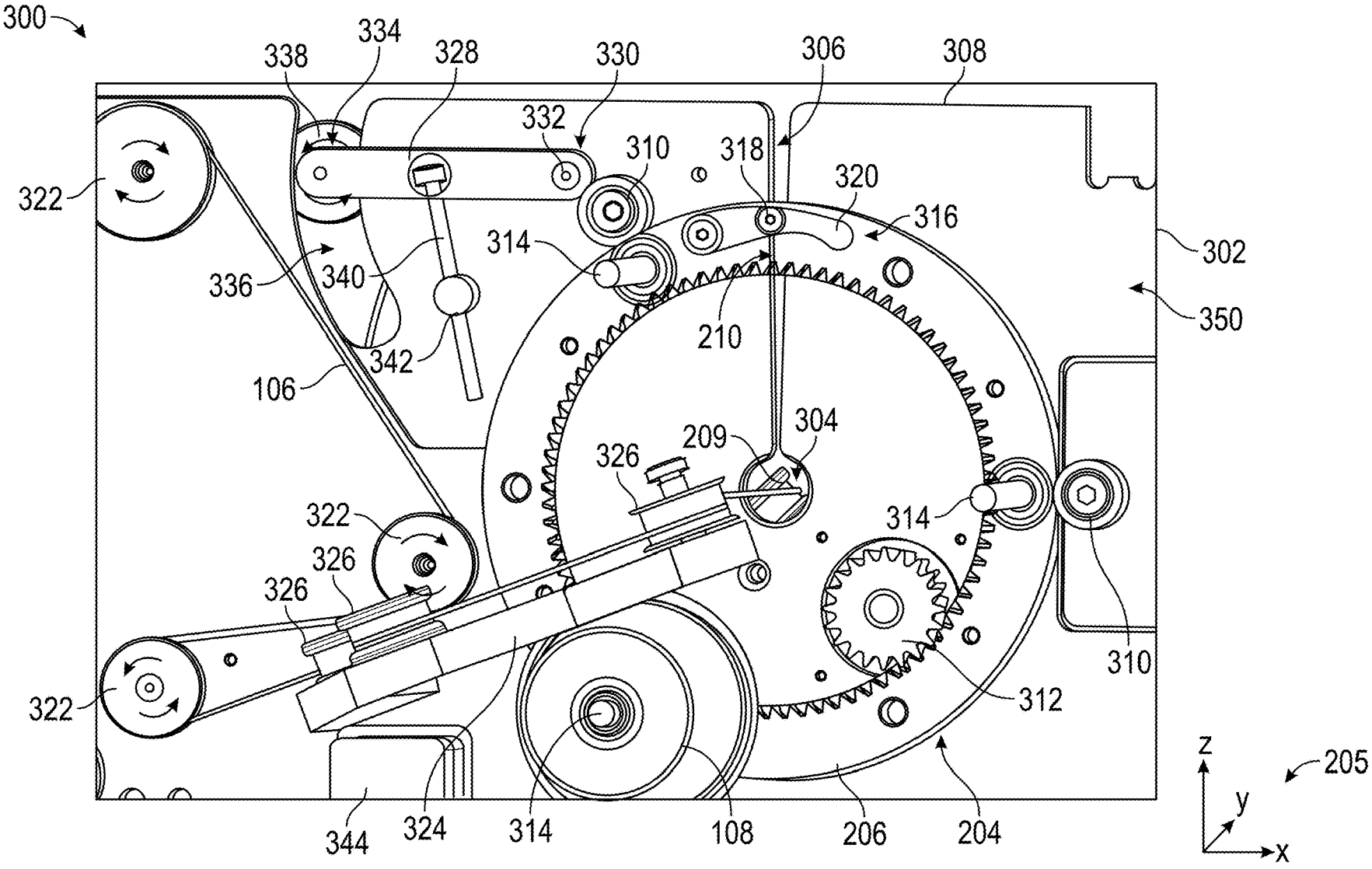
FIG. 3 shows a section of a threading machine that performs the methods disclosed herein, in an embodiment.

FIG. 3 shows a section of a threading machine 300 that performs the methods disclosed herein, in an embodiment. The section includes a plate 302 that supports the ring gear 204. The plate 302 includes a first face 350 and a second face (not shown) opposite the first face 350. A hole 304 passes through the plate 302 to allow a thread to pass through the plate 302. The ring gear 204 is arranged at the first face 350 so that the central axis 209 of the ring gear 204 is concentric with the hole 304. A slit 306 extends from an edge 308 of the plate 302 to the hole 304.

The ring gear 204 is supported at the first face 350 by roller bearings 310. In the embodiment shown in FIG. 3, three roller bearings 310 are attached to the first face 350. One roller bearing 310 is hidden in FIG. 3 by spool 108. The roller bearings 310 are in contact with the outer circumferential surface of the base circle 206 at 120 degrees from each other to support the ring gear 204.

A motor gear 312 is used to rotate the ring gear 204. The motor gear 312 includes gear teeth that mesh with gear teeth on an inner circumferential surface of the base circle 206. Pins 314 are located equidistantly from each other around the base circle 206. Each pin 314 can be used to support a spool 108. Only one pin 314 is shown as supporting a spool 108 in FIG. 3.

For illustrative purposes, the gap 210 in the base circle 206 is shown aligned with the slit 306 in the plate 302. A hinged door 316 is coupled to the base circle 206 near the gap 210. The hinged door 316 includes a hinge 318 and a cantilevered end 320 that rotates around the hinge 318. In a first position (closed position), the cantilevered end 320 extends across the gap 210 and slit 306, preventing a thread to pass through. In a second position (open position), the cantilevered end 320 is open and leaves the gap 210 unobstructed, allowing the thread 106 to pass through the gap 210. The cantilevered end 320 is in the first position when the continuous loop is being manufactured. Once the loop is created, the ring gear 204 is rotated to a position in which the gap 210 is aligned with the slit 306 and the cantilevered end 320 is placed in the second position so that the loop can be extracted from the threading machine.

A series of guide pulleys 322 direct the thread 106 along the first face 350 of the plate and through the hole 304. A cross arm 324 extends away from the first face 350 and includes crossarm pulleys 326 that move the thread 106 out of the plane of the plate 302 in order to direct the thread 106 through the hole 304 perpendicular to the plate 302.

A tension bar 328 is shown along the first face 350 of the plate 302. The tension bar 328 is attached to the first face 350 at a first end 330 by a hinge 332. A second end 334 of the tension bar 328 rotates about the hinge 332 through a groove 336 formed in the plate 302. The second end 334 supports a tension pulley 338 along the second side (FIG. 5) of the plate 302 in order to control tension of the loop at the second side of the plate 302. The location of the tension pulley 338 determines a tension in the loop. A guide bar 340 can be supported at post 342 to maintain the tension pulley 338 at a selected position. The position of the guide bar 340 can be adjusted with respect to the post 342 to adjust the tension in the loop.

Figure 5:
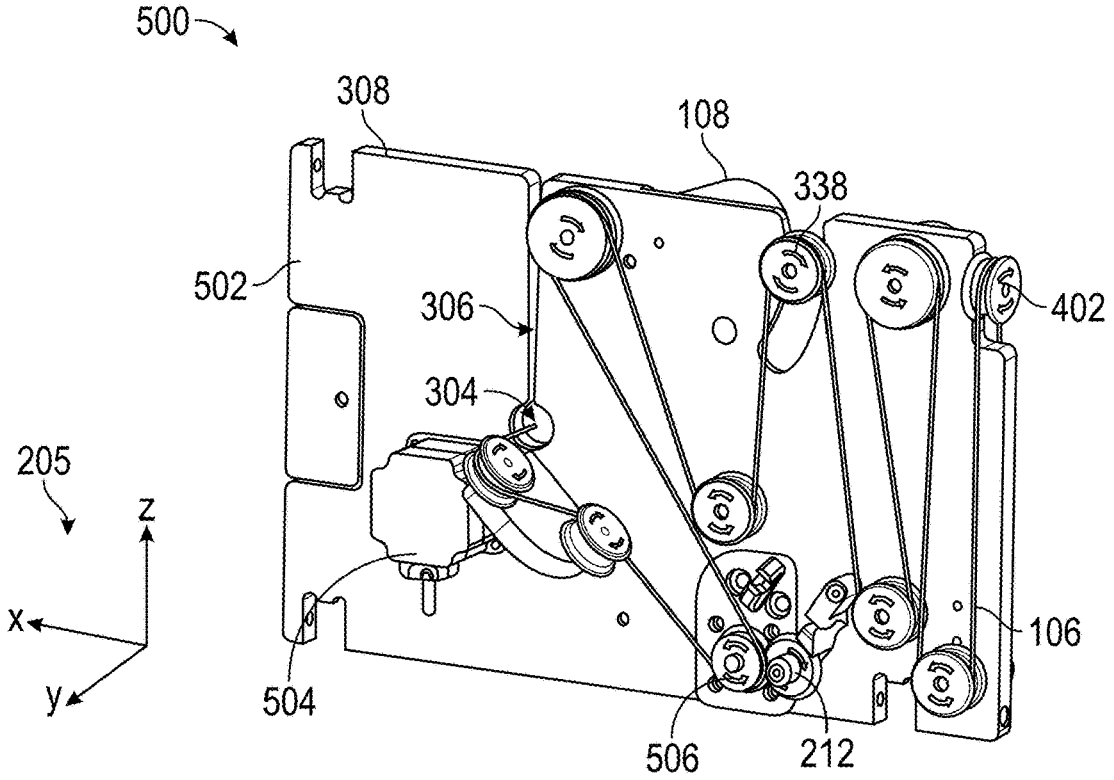
FIG. 5 shows a second face of the plate in a perspective view.

A thread circulation motor 344 is disposed at the first face 350 of the plate and is used to circulate the thread for forming the core of the loop, as discussed herein with respect to FIG. 5.

Figure 4:
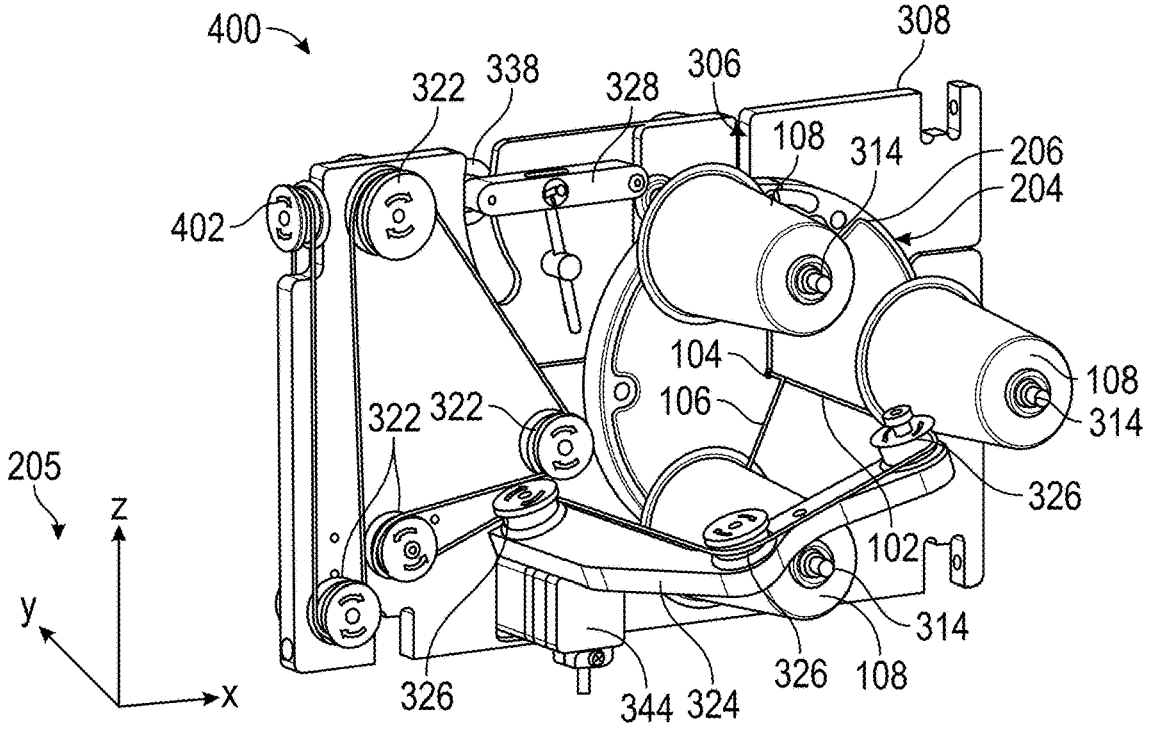
FIG. 4 shows a first face of the plate of the machine in a perspective view.

FIG. 4 shows a first face 350 of the plate 302 of the machine in a perspective view 400. The perspective view 400 includes a crossover pulley 402 that lies with its rotational axis in a plane of the plate 302. The crossover pulley 402 facilitates movement of the thread 106 from the second face of the plate 302 to the first face 350 of the plate 302 around the edge 308 of the plate 302. Three spools 108 are shown on the ring gear 204. In an embodiment, the threads from two or three spools 108 can be used to manufacture the core 102 and the outer wrap 104.

FIG. 5 shows a second face 502 of the plate 302 in a perspective view 500. The second face 502 includes a ring drive motor 504 that rotates the motor gear 312 (on the first face 350) and thus rotates the ring gear 204. The ring drive motor 504 can be turned off while the core 102 is being created and turned on to form the outer wrap 104. During the second manufacturing step, a wrap angle (helix angle) of the outer wrap 104 is dependent on a first velocity of the thread circulation motor 344 (FIG. 3) and a second velocity of the ring drive motor 504. Thus, the first velocity and the second velocity can be selected to achieve a selected wrap angle. A drive pulley 506 on the second face 502 is in contact with the pinch collar 212. The thread circulation motor 344 rotates the drive pulley 506. Contact between the drive pulley and the pinch collar 212 helps to circulate the thread 106.

Although the present invention has been described in considerable detail with reference to certain preferred versions thereof, other versions are possible. Therefore, the spirit and scope of the appended claims should not be limited to the description of the preferred versions contained herein.

The reader's attention is directed to all papers and documents which are filed concurrently with this specification, and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for"

performing a specific function, is not to be interpreted as a "means" or "step" clause as specified in 35 U.S.C § 112, sixth paragraph. In particular, the use of "step of" in the claims herein is not intended to invoke the provisions of 35 U.S.C § 112, sixth paragraph.

What is claimed is:

1. A method of manufacturing a continuous loop of twine, comprising:

unwinding a thread from a spool disposed on a ring gear to pass through a central axis of the ring gear in a threading direction;

threading the thread around the ring gear to pass through the central axis a plurality of times in the threading direction during a first manufacturing step via a drive pulley, wherein the ring gear is held stationary during the first manufacturing step to form a core of the loop; and rotating the ring gear while the thread is unwinding from the spool during a second manufacturing step to wrap the thread around the core as the core passes through the central axis in the threading direction, thereby forming an outer wrap around the core.

2. The method of claim 1, further comprising rotating the ring gear via a ring drive motor and rotating the drive pulley via a thread circulation motor, further comprising selecting a first velocity of the ring drive motor and a second velocity of the thread circulation motor to obtain a selected wrap angle of the outer wrap around the core.

3. The method of claim 1, further comprising adjusting a location of a tension pulley to adjust a tension of the thread.

4. The method of claim 1, wherein the ring gear is disposed on a first face of a plate with the central axis of the ring gear that is concentric with a hole in the plate.

5. The method of claim 4, further comprising removing the continuous loop from the ring gear through a gap in a base circle of the ring gear and a slit in the plate.

6. The method of claim 5, further comprising closing the gap with a hinged door to manufacture the continuous loop and opening the gap to remove the continuous loop.

7. A system for manufacturing a continuous loop of twine, comprising:

a ring gear rotatable about a central axis;

a spool disposed on the ring gear, the spool including a thread; and a drive pulley for unwinding the thread from the spool and through the ring gear through the central axis of the ring gear in a threading direction, where the drive pulley directs the thread through the ring gear a plurality of times;

wherein the ring gear is held stationary as the drive pulley unwinds the thread during a first manufacturing step to form a core of the continuous loop and rotates as the drive pulley unwinds the thread during a second manufacturing step to wrap the thread around the core to form an outer wrap around the core.

8. The system of claim 7, further comprising a ring drive motor for rotating the ring gear and a thread circulation motor for rotating the drive pulley, wherein a first velocity of the ring drive motor and a second velocity of the thread circulation motor are selected to obtain a selected wrap angle of the outer wrap around the core.

9. The system of claim 7, further comprising a tension pulley for adjusting a tension of the thread.

10. The system of claim 7, wherein the ring gear is disposed on a first face of a plate with the central axis of the ring gear that is concentric with a hole in the plate.

11. The system of claim 10, wherein the ring gear includes a base circle and a gap in the base circle and the plate includes a slit extended from an edge of the plate to the hole.

12. The system of claim 11, further comprising a hinged door that can be set in a first position to close the gap for manufacturing the continuous loop and a second position to open the gap to remove the continuous loop.

13. A threading machine for creating a continuous loop of twine, comprising:

a plate having a first face and a second face opposite the first face, the plate having a hole therethrough;

a ring gear disposed on the first face and rotatable about a central axis aligned with the hole;

a spool disposed on the ring gear, the spool including a thread; and a drive pulley for unwinding the thread from the spool and through the ring gear through the central axis of the ring gear in a threading direction, where the drive pulley directs the thread through the ring gear a plurality of times;

wherein the ring gear is held stationary as the drive pulley unwinds the thread during a first manufacturing step to form a core of the continuous loop and rotates as the drive pulley unwinds the thread during a second manufacturing step to wrap the thread around the core to form an outer wrap around the core.

14. The threading machine of claim 13, further comprising a ring drive motor for rotating the ring gear and a thread circulation motor for rotating the drive pulley, wherein a first velocity of the ring drive motor and a second velocity of the thread circulation motor are selected to obtain a selected wrap angle of the outer wrap around the core.

15. The threading machine of claim 13, further comprising a tension pulley for adjusting a tension of the thread.

16. The threading machine of claim 13, wherein the ring gear includes a base circle and a gap in the base circle and the plate includes a slit extended from an edge of the plate to the hole.

17. The threading machine of claim 16, further comprising a hinged door that can be set in a first position to close the gap for manufacturing the continuous loop and a second position to open the gap to remove the continuous loop.

* * * * *